United States Patent [19]

McGillivray

[11] Patent Number: 4,590,695

[45] Date of Patent: May 27, 1986

[54] ADJUSTABLE QUILTING FRAME

[76] Inventor: Dean D. McGillivray, 6121 W. Clayton Rd., Piqua, Ohio 45356

[21] Appl. No.: 756,532

[22] Filed: Jul. 19, 1985

[51] Int. Cl.[4] ..... D06C 3/08; D05C 1/04

[52] U.S. Cl. ..... 38/102.2; 248/278

[58] Field of Search ..... 248/278, 122; 38/102.1, 38/102.2; 269/71, 75

[56] References Cited

U.S. PATENT DOCUMENTS

| | | | |
|---|---|---|---|
| 707,353 | 8/1902 | Post | 38/102.2 |
| 744,070 | 11/1903 | Harmes | 38/102.2 |
| 2,616,692 | 11/1952 | Bird | 248/122 X |
| 2,621,882 | 12/1952 | Fletcher | 248/278 X |
| 3,243,497 | 3/1966 | Kendall et al. | 248/278 X |
| 3,329,149 | 7/1967 | Kendall et al. | 248/278 |
| 3,428,286 | 2/1969 | Del Pesco | 248/278 X |
| 3,906,648 | 9/1975 | Bard | 38/102.2 |

FOREIGN PATENT DOCUMENTS

| | | | |
|---|---|---|---|
| 2382140 | 10/1978 | France | 248/122 |

*Primary Examiner*—Werner H. Schroeder
*Assistant Examiner*—Andrew M. Falik
*Attorney, Agent, or Firm*—Biebel, French & Nauman

[57] ABSTRACT

An adjustable quilting frame having a base, an articulated arm pivotally attached to the base, a positionable joint attached to an outer end of the arm, and a cradle attached to the joint and including a hoop assembly adapted to hold a fabric workpiece. All of the joints include releasable locking nuts which enable them to be alternately loosened and tightened so that the articulated arm and joint can be positioned to orient the hoop assembly at any desired angle, at a variety of distances from the base, and at a variety of elevations above a floor.

7 Claims, 4 Drawing Figures

ADJUSTABLE QUILTING FRAME

BACKGROUND OF THE INVENTION

The present invention relates to frames for supporting fabric for needlework activity and, more particularly, for adjustable frames for holding fabric for quilting activity.

In performing needlework activity upon a sheet of fabric, it is preferable to mount the fabric on a jig or frame which holds at least the portion of the fabric to be worked upon taut and in a planar configuration. It is also preferable that the frame hold the fabric so that both surfaces of the fabric are readily accessible by the hands of the user, since the needlework operation involves passing a needle and thread repeatedly through the plane of the fabric.

A typical structure used to hold needleworking fabric is shown in the Solaini U.S. Pat. No. 1,357,737. That patent shows an embroidery frame which includes a jig consisting of inner and outer concentric hoops, the outer hoop being split and having a tightening screw extending between its ends so that it can be tightened about the periphery of the inner hoop. The fabric to be worked upon is stretched across the inner hoop and held in position by the clamping engagement of the outer hoop against the inner hoop. The hoops are mounted on a floor stand having an upright post and a pivot connection so that the hoops can be tilted relative to the horizontal.

A similar device is shown in Parsons et al. U.S. Pat. No. 3,855,718. However, the Parsons et al. framework differs in that the bracket supporting the concentric hoops is attached to a floor stand by a ball and socket connection, which permits the hoop to be tilted from the horizontal in any direction.

Other types of needlework frames are shown in Mathews U.S. Pat. No. 4,175,343; Bard U.S. Pat. No. 3,955,722; and Johnson et al. U.S. Pat. No. 3,744,325. Each of these patents shows a needlework supporting hoop assembly or the like which, in turn, is supported by a base or stand. The hoop assembly is connected to the stand by a pivotal attachment which permits the assembly jig to be tilted relative to the horizontal.

The fabric workpiece for performing quilting work generally is much larger and heavier than the fabric workpiece utilized in other types of needleworking operations. Furthermore, quilting of needlework often requires a relatively large area of the fabric workpiece to be held taut, so that larger patterns or larger pieces of fabric can be sewn onto the fabric workpiece. The needlework support frames shown in the aforementioned patents are in appropriate for use with such large fabric workpieces since relatively small support bases are not sufficiently sturdy to support such a large workpiece.

In addition, in the aforementioned devices in which the hoop structure is positioned directly above the support base, or immediately adjacent to a supporting structure, the entire structure may be covered by a large fabric workpiece used for quilting activity. Since it is necessary that both sides of the workpiece be accessible to a user, such frames make it difficult to reach the underside of the workpiece held in the hoop structure.

Accordingly, there is a need for a needlework frame which is specially adapted to accommodate the larger fabric workpieces of quilting operations. Such a frame should be sufficiently sturdy to handle the increased weight of the quilting workpiece and should hold the particular portion of the workpiece which is to be worked upon in such a manner that both sides of that portion are readily accessible by a user.

SUMMARY OF THE INVENTION

The present invention is an adjustable quilting frame having a base, an articulated arm pivotally mounted on the base, a joint attached to the end of the arm, and a cradle which is attached to the end of the joint and includes a hoop assembly for supporting the portion of the fabric workpiece to be worked upon. Each of the pivot connections of the articulated arm and the joint are releasably lockable so that the articulated arm and joint may be positioned to orient the hoop structure at a number of different elevations and distances from the base, as well as at a number of different orientations relative to the horizontal. Consequently, the adjustable quilting frame of the present invention possesses a flexibility which is superior to prior art quilting frames.

The joint is a universal-type joint and, in a preferred embodiment, includes a first member pivotally attached to the articulated arm and a second member pivotally attached to the first member and oriented to pivot about an axis which is perpendicular to the pivot axis of the first member. The cradle is pivotally attached to the second member and is oriented to pivot about an axis which is perpendicular to the pivot axes of the first and second members. Consequently, the hoop structure, which is attached to the cradle, can be positioned at virtually any angular orientation.

The cradle is a C-shaped structure which is attached to the second member at an upper portion and in which the hoop structure is attached to a lower portion. When the fabric workpiece is supported by the hoop structure, a portion of the fabric outside of the area held taut by the hoop structure is gathered within the crook of the C-shaped cradle, while the remaining fabric is free to hang downwardly to the floor. This gathered portion provides an opening for easy access to the underside of the material held rigid by the hoop structure.

The articulated arm includes a base pivot which is journaled on a boss extending upwardly from the base, a first segment pivotally attached to the base pivot, and a second segment pivotally attached to the first segment and to the joint. The joint extends downwardly from the end of the second segment and the cradle extends downwardly from the joint. Consequently, the hoop structure is supported entirely by overhead structure and there is no structure which is directly beneath the hoop structure to obstruct a user or to prevent a user from placing himself or a chair directly beneath the hoop structure. Another advantage of the overhead structure is that the pivot connections of the articulated arm and joint are readily accessible to a user so that adjustments in the orientation of the arm and joint can be made relatively easily.

Accordingly, it is an object of the present invention to provide an adjustable quilting frame which is sufficiently rigid to support a relatively large size fabric workpiece of the type used in quilting; a frame in which the support hoops may be positioned at a variety of elevations and distances from a support base; a frame in which the support hoops can be tilted at a variety of orientations to the horizontal; a frame in which the structure supporting the hoop assembly is located substantially above the hoop structure; a frame in which the hoop support structure includes a cradle to facilitate access to the underside of the material supported by the hoop structure; and a frame which is easily adjustable by a user.

Other objects and advantages of the present invention will become apparent from the following description, the accompanying drawings, and the appended claims.

DETAILED DESCRIPTION OF THE PREFERRED EMBODIMENT

Figure 1:
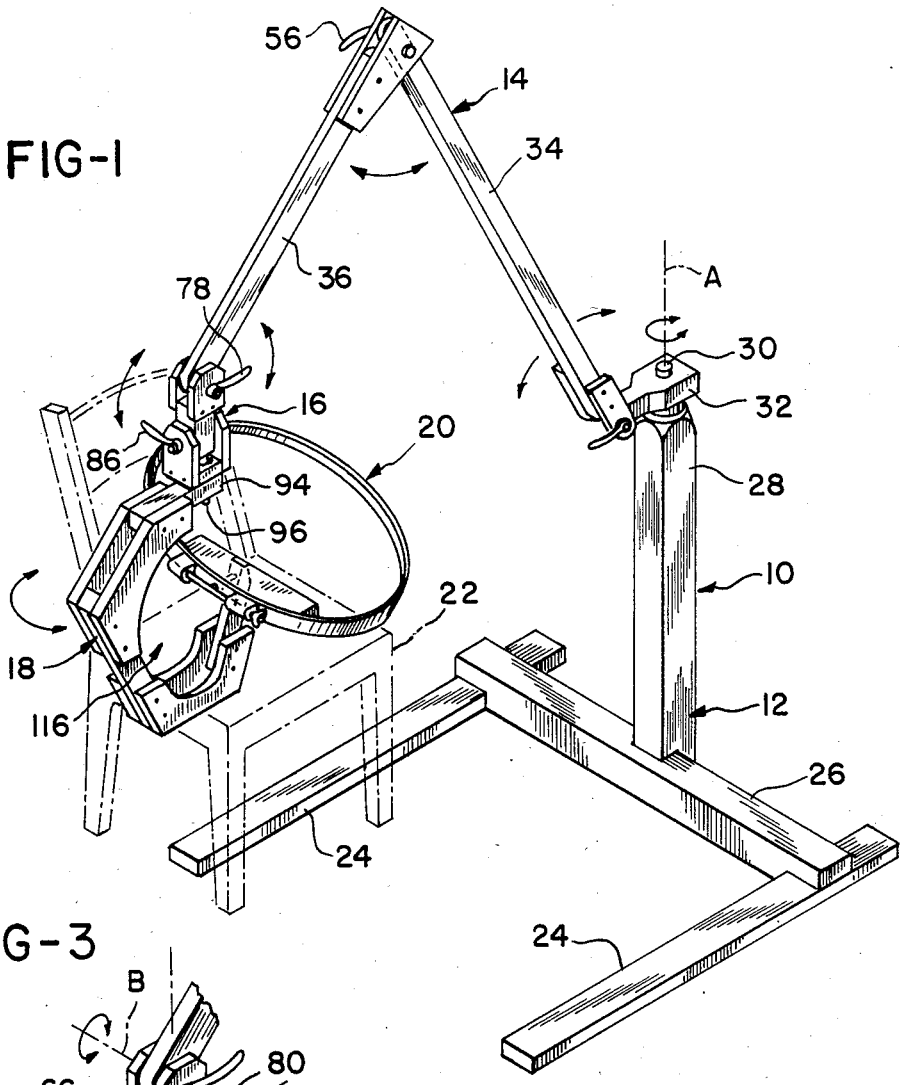
FIG. 1 is a perspective view of a preferred embodiment of the invention and a chair shown in phantom.

The preferred embodiment of the adjustable quilting frame, generally designated 10, is shown in FIG. 1. The frame 10 includes a base 12, an articulated arm 14 which is pivotally mounted on the base, a joint 16 which is pivotally attached to an end of the arm, and a cradle 18 which is pivotally attached to the joint and includes a hoop assembly 20. The joint 16 extends generally downwardly from the articulated arm 14 and the cradle 18 extends generally downwardly from the joint. Accordingly, the structure which supports the hoop assembly 20 extends above the hoop assembly, leaving the space below the hoop assembly open and appropriate for placing a chair 22 beneath it.

The base 12 includes a pair of elongate legs 24 which are attached by bolts (not shown) to a cross beam 26 and are oriented parallel to each other. A post 28 is attached to a mid-portion of the cross beam 26 and extends upwardly therefrom to terminate in a cylindrical boss 30.

Figure 2:
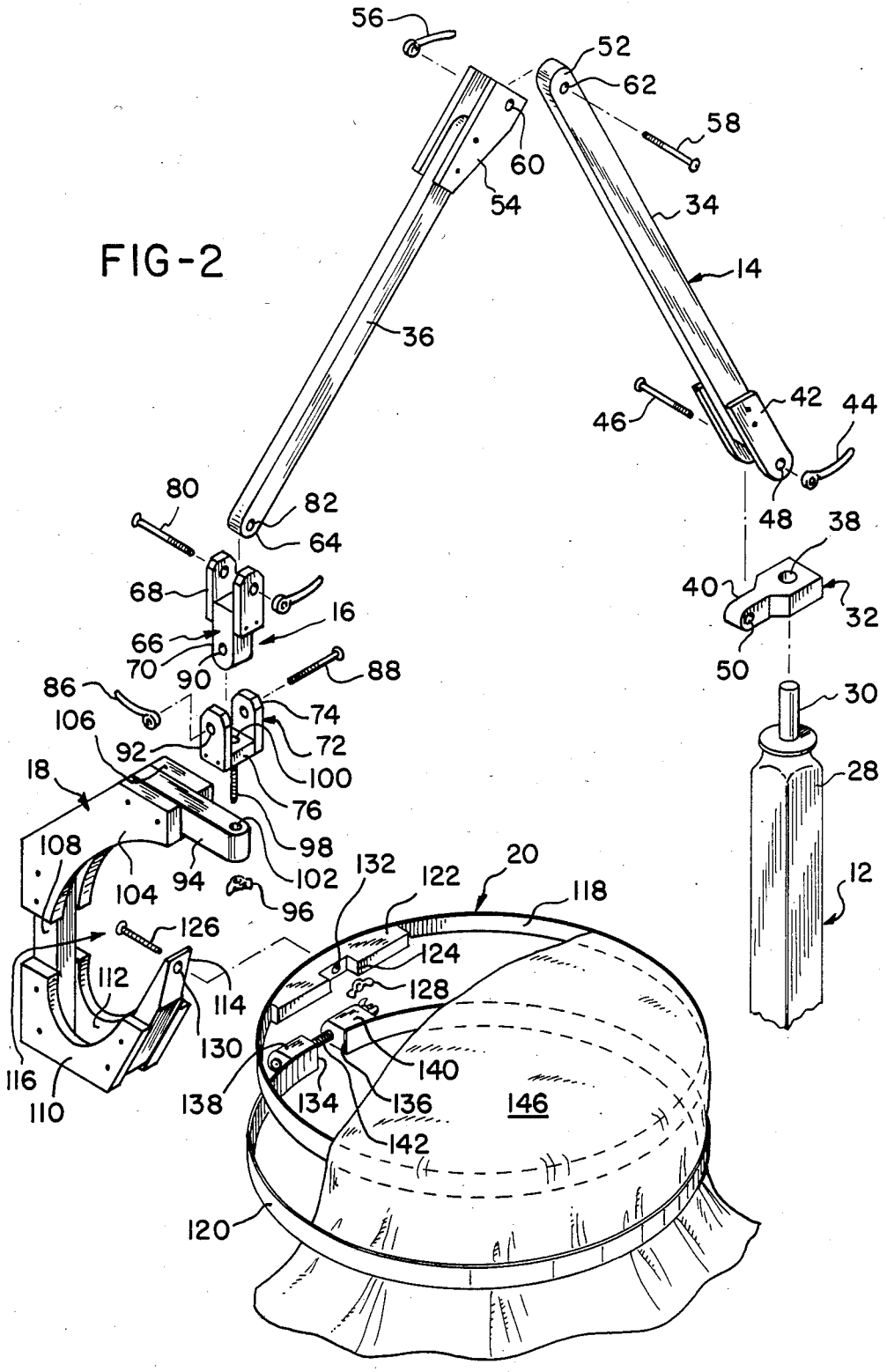
FIG. 2 is an exploded detail view of the articulated arm, joint, and cradle of the embodiment of FIG. 1, in which a fabric workpiece is shown mounted on the hoop assembly.

As shown in FIGS. 1 and 2, the articulated arm 14 includes a base pivot 32, a first segment 34, and a second segment 36. The base pivot 32 includes a bore 38 extending therethrough which receives the boss 30 of the post 28 so that the base pivot is mounted on the base 12 to pivot about a vertical axis A.

The base pivot 32 includes a knuckle 40 and the first segment 34 includes a clevis end 42 which is shaped to receive the knuckle. The knuckle 40 and clevis 42 are pivotally attached by a handled wing nut 44 and a carriage bolt 46 which passes through bores 48 of the clevis and bore 50 of the knuckle.

The first segment 34 is elongate in shape and includes a knuckle 52 formed at its end opposite the clevis 42. The second segment 36 includes an end forming a clevis 54 which is shaped to receive the knuckle 52 of the first member 34. A handled wing nut 56 and carriage bolt 58 form a second pivot connection in which the carriage bolt passes through bores 60, 62 of the clevis 54 and knuckle 52, respectively.

Figure 3:
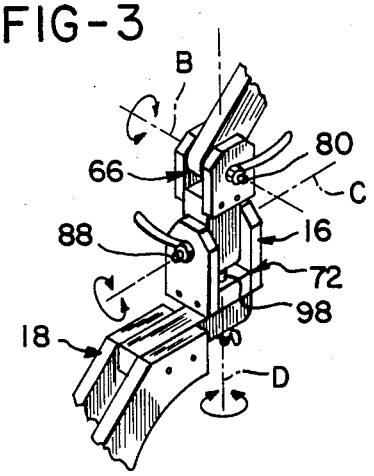
FIG. 3 is a detail perspective view of the joint of the embodiment of FIG. 1.

The second segment 36 is elongate in shape, similar to that of first member 34, and terminates in a knuckle 64, which is attached to the joint 16, as shown in FIGS. 2 and 3. The joint 16 includes a first member 66 having a clevis 68 at an upper end and a knuckle 70 at a lower end thereof. A second member 72 includes a clevis 74 at an upper end and a substantially flat web 76 at a lower end.

The knuckle 64 of the second segment 36 is received within the clevis 68 of the first member 66 and is pivotally attached thereto by a handled wing nut 78 and carriage bolt 80 which passes through bores 82, 84 of the second segment and first member, respectively. The clevis 74 of the second member 72 is shaped to receive the knuckle 70 of the first member 66 and a pivot attachment is formed by the handled wing nut 86 and bolt 88, the latter of which passes through bores 90, 92 of the knuckle and clevis, respectively.

The cradle 18 is generally C-shaped and includes an upper tongue 94 which is pivotally attached to the web 76 of the second member 72 by a wing nut 96 and carriage bolt 98, in which the carriage bolt extends through bores 100, 102 of the web and tongue, respectively. As shown in FIG. 3, the bolts 80, 88, 98 define pivot axes B, C, D which are at all times oriented substantially perpendicularly to each other. Axes B and C extend generally horizontally, while axis D extends generally vertically, so that the cradle 18 pivots about a vertical axis with respect to the joint 16. However, the cradle 18 can be oriented in virtually any position relative to the horizontal by virtue of the perpendicular pivot axes B, C of the joint 16.

As best shown in FIG. 2, the cradle 18 also includes a pair of upper gussets 104, 106 which support the upper tongue 94 and mid-strut 108. A pair of lower gussets 110, 112 are attached to and support the mid-strut 108 and lower tongue 114. The components extending from the upper tongue 94 to the lower tongue 114 form a C-shape defining an interior crook portion 116.

Figure 4:
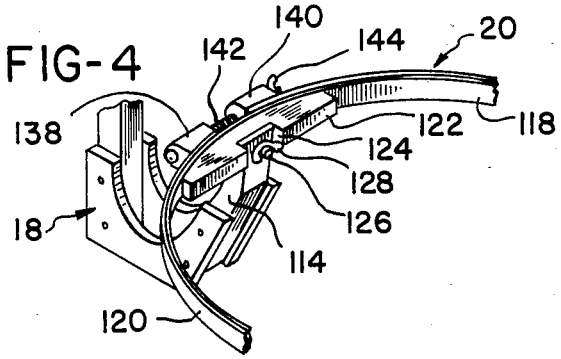
FIG. 4 is a detail perspective view of the hoop mount.

The hoop assembly 20 includes an inner hoop 118 and an outer hoop 120 which extends about the outer periphery of the inner hoop and is concentric with it. As shown in FIGS. 2 and 4, the inner hoop includes a mounting block 122 which has a notch 124 shaped to receive the end of the lower tongue 114 and is secured to the tongue by a bolt 126 and wing nut 128 combination in which the bolt passes through bores 130, 132 formed in the tongue and bracket, respectively. The outer hoop 120 is split and the ends 134, 136 include lugs 138, 140 through which a bolt 142 extends. Bolt 142 receives a wing nut 144 on an end such that displacement 144 causes the ends 134, 136 to be drawn together or allowed to separate as a result of the inherent resiliency of the outer hoop 120.

The operation of the quilting frame 10 is as follows, and is described with reference to FIG. 1. In order to fix the hoop assembly 20 at the desired elevation from the floor and distance from the post 28 of the base 12, the articulated arm 14 is adjusted. Handled wing nuts 44, 56 of the first and second segments 34, 36 are rotated to loosen the clamping force of the connections to allow the first segment to be pivoted relative to the base pivot 32 and the second segment to be pivoted relative to the first segment. With the orientation of the legs 24 as shown in FIG. 1, it is preferable that the cradle 18 and hoop assembly 20 be positioned outwardly between them, since this provides the most stable support. Once the preferred orientation of the first and second segments 34, 36 has been determined, the wing nuts 44, 56 are tightened to lock the arm 14 in this position.

In order to position the cradle 18 and hoop assembly 20 at the desired orientation, the handled wing nuts 78, 86 of the joint 16 are loosened, as well as the wing nut 96 on the underside of the upper tongue 94 of the cradle. This allows the first and second members 66, 72 to be pivoted about axes B and C, respectively (FIG. 3). The final adjustment is made by pivoting the cradle 18 about the substantially vertical axis D, then tightening the wing nuts 78, 86, 96.

After all of the adjustments have been made and the quilting frame 10 locked in position by the tightening of the wing nuts, the arm 14 and cradle 18 are still free to pivot about the axis A at the boss 30 on the post 28. This enables a user seated in the chair 22 to swing the arm 14 and cradle 18 toward himself to begin a quilting operation, or swing the assembly away to enable him to leave the chair.

As shown in FIG. 2, a fabric workpiece 146 is then mounted on the hoop assembly 20 by placing it over the inner hoop 18 and extending it downwardly within the perimeter of the outer hoop 120. The outer hoop 120 is positioned as shown in FIG. 1 so that it is concentric with and surrounds the periphery of the inner hoop 118, and the wing nut 144 is displaced along bolt 142 to bring the ends 134, 136 of the hoop together to secure the workpiece 146 on the hoop assembly 20. The ends of the workpiece 146 which are not stretched over the inner hoop 118 are free to hang downwardly but are gathered within the crook portion 116 of the cradle 18.

The crook portion 116 is rigid to receive a large amount of fabric and keep it out of the way of the hoop 20. In addition, it acts to hold up the outer portion of the workpiece 146 at one location to enable a user to reach beneath the hoop assembly 20 to gain access to the underside of the workpiece 146. The quilting operation can now be performed such that the work area defined by the hoop assembly 20 is oriented at an elevation and an angle to the horizontal which is optimal for a particular user. Once the quilting process has been completed for the particular area defined by the hoop assembly 20, the arm 14 and cradle 18 may be swung away from the user to enable him to rise from the chair 22.

In the preferred embodiment of the invention, all of the components of the frame 10, save for the hardware components such as the wing nuts and bolts, may be made of wood and stained or painted to provide a pleasing aesthetic appearance. However, it is within the scope of the invention to construct the frame 10 of different materials such as aluminum or rigid plastics such as nylon.

While the form of apparatus herein described constitutes a preferred embodiment of the invention, it is to be understood that the invention is not limited to this precise form of apparatus, and that changes may be made therein without departing from the scope of the invention.

What is claimed is:

1. An adjustable quilting frame comprising:

a base;

an articulated arm pivotally attached to said base;

a positionable joint attached to said arm and having a first member attached to said arm to pivot about a first axis, and a second member attached to said first member to pivot about a second axis;

a cradle attached to said second member to pivot about a third axis, said cradle having a C-shape and being connected at an upper end thereof to said second member;

hoop means for retaining a quilt, said hoop means having an inner hoop member attached to a lower end of said cradle and an outer split hoop member carried on said inner hoop member, said hoop means being spaced separately from and below said upper end of said cradle such that an open crook portion of said cradle extends between said upper and lower ends thereof; and means for releasably locking said first member to said arm means, said second member to said first member, and said cradle means to said second member, whereby said hoop means may be fixed at a predetermined orientation and elevation.

2. The frame of claim 1 wherein said first, second, and third axes are oriented substantially perpendicularly to each other.

3. The frame of claim 2 wherein said base means includes a base post having a boss extending upwardly therefrom, and said arm includes a base pivot at an end thereof journaled on said boss for rotation about a substantially vertical axis.

4. The frame of claim 3 wherein said first axis is oriented substantially horizontally and said third axis is oriented substantially vertically.

5. The frame of claim 4 wherein said arm includes a first segment pivotally attached to said base pivot and a second segment pivotally attached to said first segment and said joint means.

6. The frame of claim 5 wherein said arm includes means for locking said first segment to said base pivot, said second segment to said first segment, and said joint to said second segment, whereby said arm may be fixed at a predetermined orientation such that said cradle means and said hoop means may be positioned at a predetermined elevation and distance from said base means.

7. The frame of claim 6 wherein joint means depends downwardly from said arm and said cradle depends downwardly from said joint means such that said arm, said joint, and said cradle is positioned generally above said hoop means.

* * * * *